US006942266B1

(12) United States Patent
Van Sickle

(10) Patent No.: US 6,942,266 B1
(45) Date of Patent: Sep. 13, 2005

(54) RIM FLANGE CLAMP

(76) Inventor: Randy Van Sickle, P.O. Box 101, Kenai, AK (US) 99611

( * ) Notice: Subject to any disclaimer, the term of this patent is extended or adjusted under 35 U.S.C. 154(b) by 237 days.

(21) Appl. No.: 10/300,261

(22) Filed: Nov. 19, 2002

Related U.S. Application Data

(60) Provisional application No. 60/281,537, filed on Apr. 2, 2001.

(51) Int. Cl.[7] ..... B66C 1/28
(52) U.S. Cl. ..... 294/104; 294/82.13
(58) Field of Search ..... 294/82.13, 82.21, 294/82.23, 90, 101, 104

(56) References Cited

U.S. PATENT DOCUMENTS 815,452 A * 3/1906 Maynard ..... 294/82.13
1,039,957 A * 10/1912 Kempton ..... 294/82.23
1,161,751 A * 11/1915 Sullivan ..... 294/82.14
1,580,083 A * 4/1926 Boadle ..... 294/104
3,262,731 A * 7/1966 Renfroe ..... 294/101
3,274,657 A * 9/1966 Renfroe ..... 294/104

* cited by examiner

*Primary Examiner*—Dean J. Kramer
(74) *Attorney, Agent, or Firm*—Michael Tavella

(57) ABSTRACT

A device that clamps to the flange ring of a tire. The clamp has a rear section that can be used to attach a lifting chain or other implement to facilitate the removal and lifting of these flanges. The device consists of a pair of jaws mounted on a body. The jaws can pivot to open and close them about a rim flange. A bolt secures the clamp in place and is used to remove it when it is no longer needed. The clamp also has an eye or hook for attaching a chain for lifting or pulling on the flange.

8 Claims, 8 Drawing Sheets

RIM FLANGE CLAMP

CROSS REFERENCE TO RELATED APPLICATIONS

This application claims benefit of U.S. Provisional Application No. 60/281,537, filed Apr. 2, 2001.

STATEMENT REGARDING FEDERALLY SPONSORED RESEARCH AND DEVELOPMENT

Not Applicable

BACKGROUND OF THE INVENTION

1. Field of the Invention

This invention relates to rim flange clamps and particularly to rim flange clamps that have lifting capability.

2. Description of the Prior Art

This invention relates generally to an apparatus for removing or replacing flange rings and bead seat band rings on large tires. In the repair of large tires such as those used on heavy-duty equipment, it is often necessary to remove the tire rim from the rim assembly. In tire installations such as these, the rims are large and heavy components. These rims must be carried to be positioned and set so that the tries can be installed. Moving these large rims requires a lot of muscle or equipment. Being able to lift and maneuver these rims makes the job easier and safer. To move the rims by a small lift or crane, there must be a convenient way to attach the lifting chains to the rims so that it can be lifted or moved.

One tool for such an operation is found in U.S. Pat. No. 2,900,016. This tool is used to force the tire away from the edge of the rim as part of the installation or removal process. This device is a small clamp that clamps to the ring around the tire. It has an arm that attaches to a large lever that is used to push the tire away from the rim. Once the bead seal has been broken, the tool is moved to another location on the rim. Although this tool is useful in breaking a tire free of the rim, it has no means for removing or lifting the rim.

BRIEF DESCRIPTION OF THE INVENTION

The instant overcomes the problems of moving these large rims. It is a device that clamps to the flange ring. The clamp has a rear section that can be used to attach a lifting chain or other implement to facilitate the removal and lifting of these flanges. The device consists of a pair of jaws mounted on a body. The jaws can pivot to open and close them about a rim flange. A means for tightening the clamp is provided to secure the clamp in place and to remove it when it is no longer needed. The clamp also has a means for attaching a chain for lifting or pulling on the flange.

It is an object of this invention to produce a tool for convenient lifting and handling of the rim ring gear.

It is a further object of this invention to produce a tool for convenient lifting and handling of the rim ring gear while as tire is mounted on the rim.

It is yet a further object of the invention to produce a tool for convenient lifting and handling of the rim ring gear that is small, simple and economical to use.

DETAILED DESCRIPTION OF THE INVENTION

Figure 1:
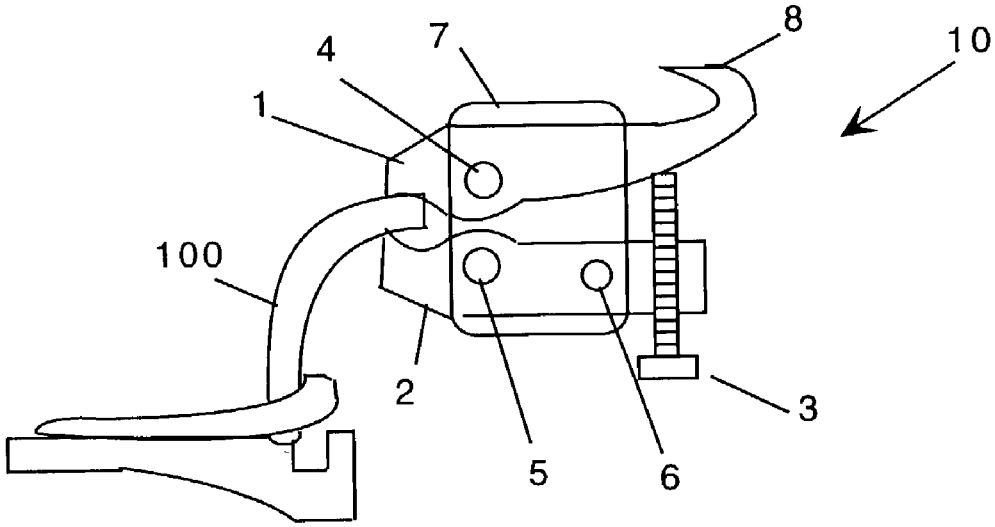
FIG. 1 is a side view of the invention positioned on a rim showing the hook member in an upward orientation.

Referring now to FIG. 1, a first embodiment of the tool 10 is shown. The tool has two side plates 7 that are oppositely disposed. Two clamping jaws 1 and 2 are mounted between them. As shown, jaw 1 has a chisel point edged clam jaw at one end, which is secured to the flange ring 100. The jaw 1 has a taper that narrows toward the other end of the jaw. The second end of the jaw 1 ends in a grab hook 8 as shown. FIG. 1 shows the grab hook 8 facing upward.

Jaw 1 is secured in between the side plates by a bolt that fits in a bushed cap hole 4. This bolt allows jaw 1 to pivot about the bolt.

The second jaw 2 has a chisel point edged clamp jaw at one end that is shown secured to the flange ring 100. Note the placement of this jaw 2 is opposite to that of jaw 1. Together these jaws form a clamp.

Jaw 2 is secured to the side plates 7 by two cap bolts 5 and 6. Jaw 2 is not tapered. The two cap bolts 5 and 6 secure jaw 2 to the plates so that it is fixed with respect to jaw 1.

Near the end of jaw 1 opposite of that having the clamp jaw, is a threaded hole through which torque bolt 3 passes. Torque bolt 3 is used to activate the clamp. By tightening the bolt 3 into the jaw, it pushes upward against jaw 1, which causes the hook end of jaw 1 to move upward, which in turn causes jaw 1 to pivot, there by pressing jaw 1 hard against the rim flange 100. This secures the clamp to the rim flange for use.

Figure 2:
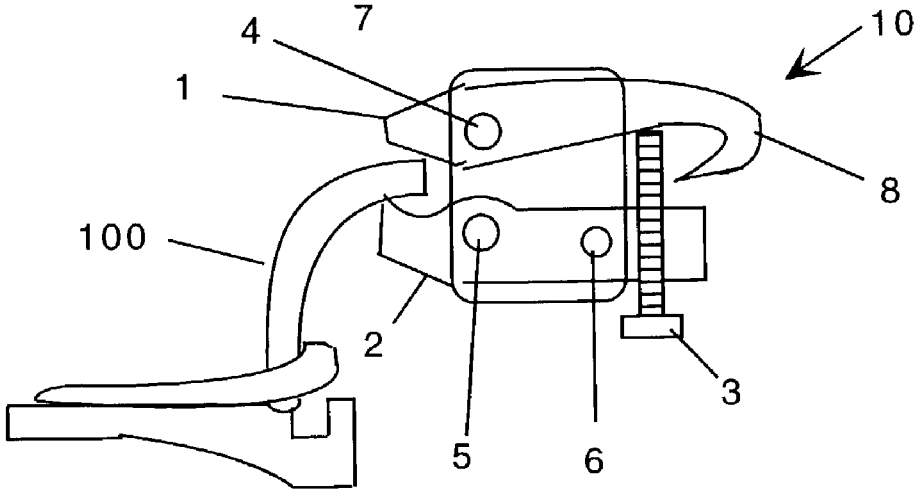
FIG. 2 is a side view of the invention positioned on a rim showing the hook member in a downward orientation.

FIG. 2 shows the same tool with a modification to jaw 1. Here, jaw 1 has the same end clamp and taper. In this embodiment, however, the grab hook 8 is turned downward instead of upward as in FIG. 1.

The tool is used as follows: first, the clamping jaws are opened by turning the torque screw 3 outwards, which allows jaw 1 to pivot upwards. The tool is then placed over a flange ring until the flange ring comes into contact with the side plates 7. Torque bolt 3 is then turned until jaw 1 pivots against the flange rim and holds the ring firmly.

Ordinarily, two tools are placed 180 degrees apart on the flange. Then a length of chain is secured between them by attaching the chain to the grab hooks on jaw 1. Next, the chain, or other pulling implement, such as a wire rope, or nylon rope, a come-along winch or similar tool, can be lifted in the center of then chain. The force exerted on the chain is placed on the pivoting jaws 1 on both clamps. This force increases the grip on the flange by the two jaws 1.

Lifting the chain at the center of the flange ring also causes the flange ring and bead seat band to come off the rim assembly.

Setting the rings down on a flat surface releases the pressure on the pivoting jaws 1. The chain can then be removed from the hooks and the torque bolt 3 can be loosened, which allows the pivoting jaw 1 to release from the rim flange, allowing the tool to be removed.

Figure 3:
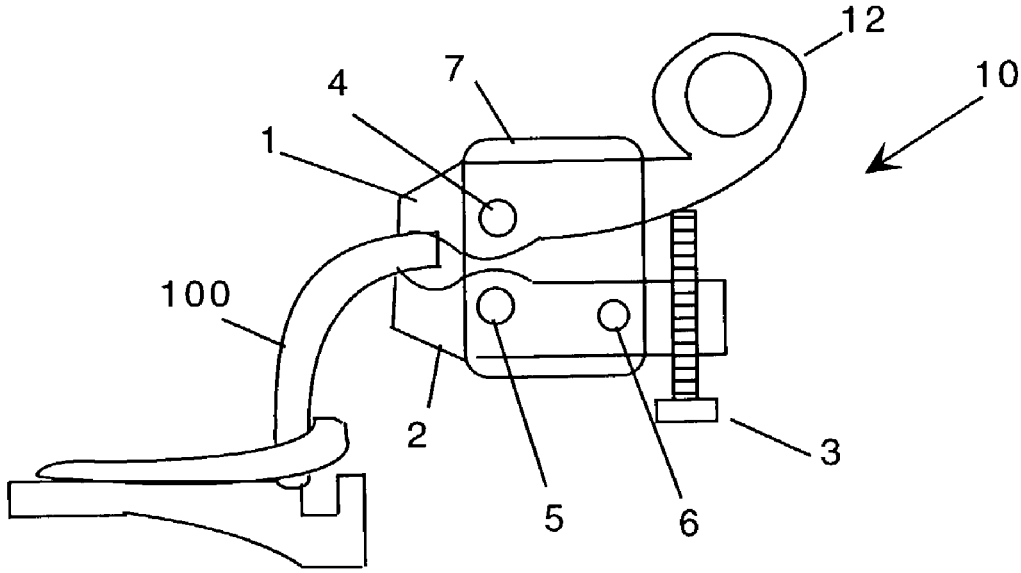
FIG. 3 is an alternative embodiment of the invention.

FIG. 3 is an alternative embodiment in which the grab hook 8 has been replaced with an eye 12 that can be used with a shackle (not shown). In this way, the eye can be used as a modified version of the grab hook for operations as before.

FIGS. 4–15 show a third embodiment of the invention. This embodiment of the invention is similar to the second embodiment except that the eye is formed as a part of the jaw.

Figure 4:
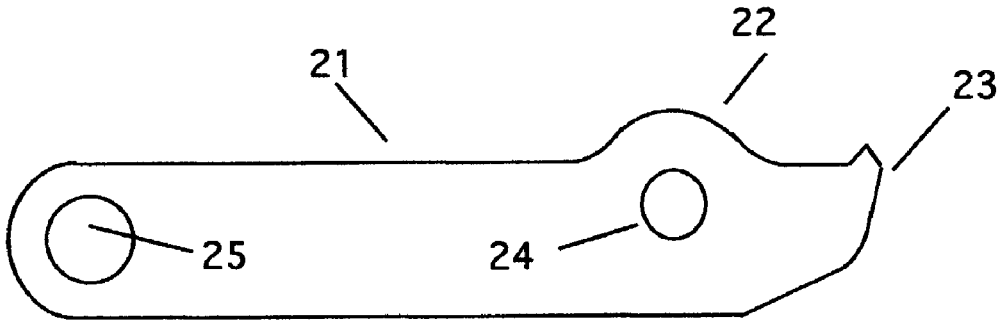
FIG. 4 is a side view of a first jaw of a third embodiment.
Figure 5:
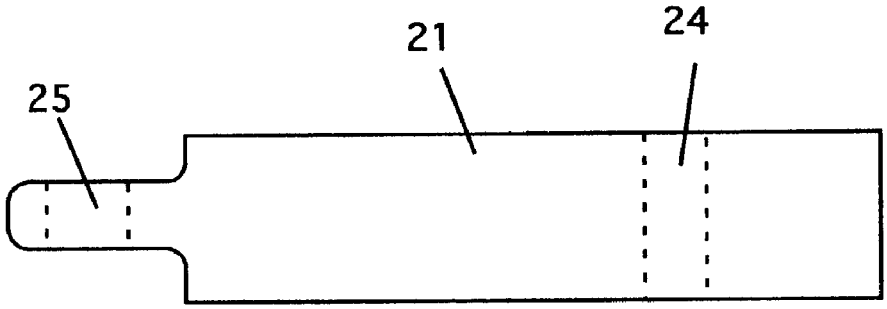
FIG. 5 is a top view of the first jaw of a third embodiment.

FIG. 4 is a side view of a first jaw 21 of a third embodiment 20. This jaw has a rounded body that has an enlarged pivot head 22 and a chisel point end 23 as in the earlier embodiments. This jaw 21 has a pivot hole 24 and a tool hole 25. The tool hole 25 is used to secure a shackle or other fastener for use with chains, or other pulling implements, as described above. FIG. 5 is a top view of this jaw 21. This view shows the placement of the holes 24 and 25.

Figure 6:
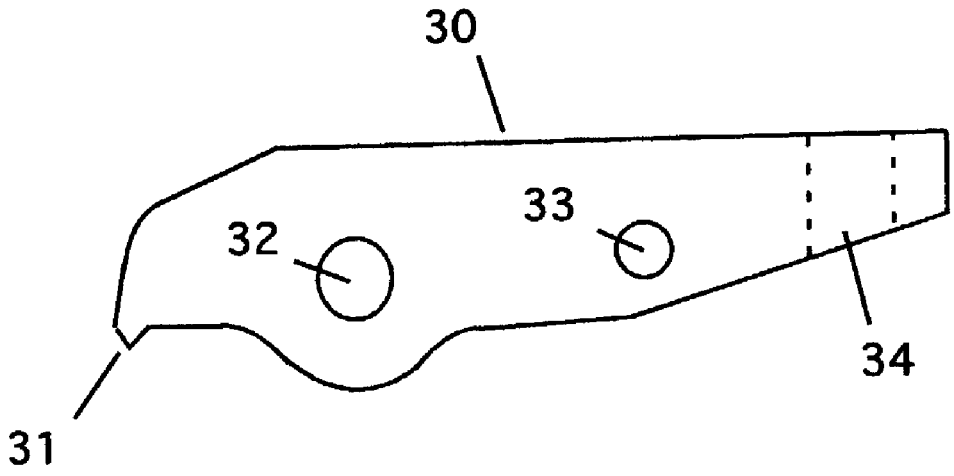
FIG. 6 is a side view of a second jaw of a third embodiment.
Figure 7:
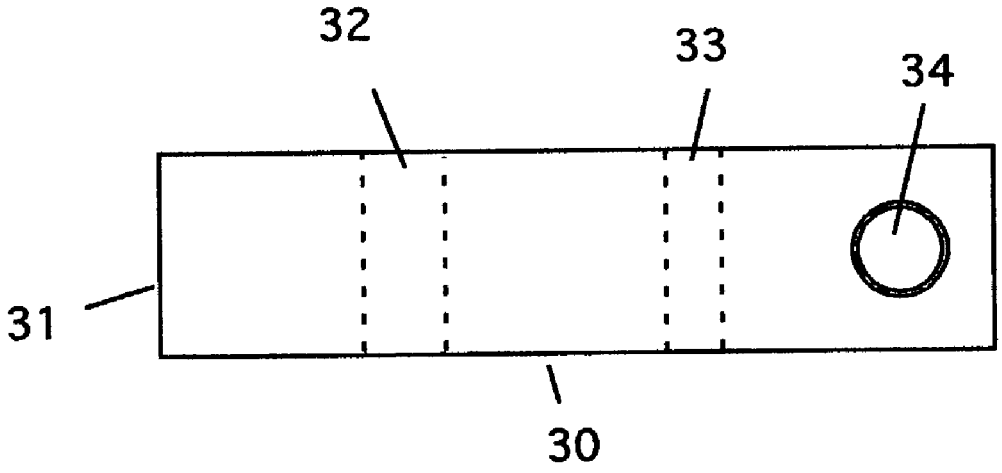
FIG. 7 is a top view of the second jaw of a third embodiment.

FIG. 6 is a side view of a second jaw 30 of a third embodiment 20. This jaw 30 has a chisel point end 31 that corresponds to the end 23 of the first jaw 21. This jaw 30 has two mounting holes 32 and 33 as shown. A hole 34, perpendicular to the mounting holes, is used to hold the torque bolt 35 (see, e.g., FIG. 12) that is used to activate the clamp, as in the pervious embodiments. FIG. 7 is a top view of the second jaw 30 of the third embodiment.

Figure 8:
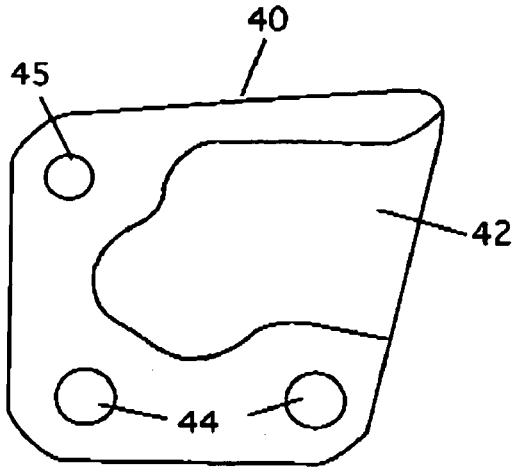
FIG. 8 is an inside view of the left side housing of the third embodiment.
Figure 10:
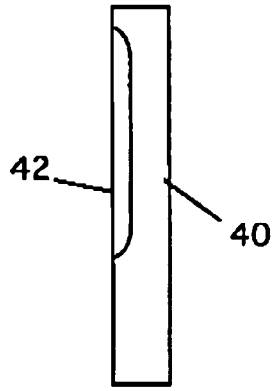
FIG. 10 is a front view of the left side housing of the third embodiment.
Figure 9:
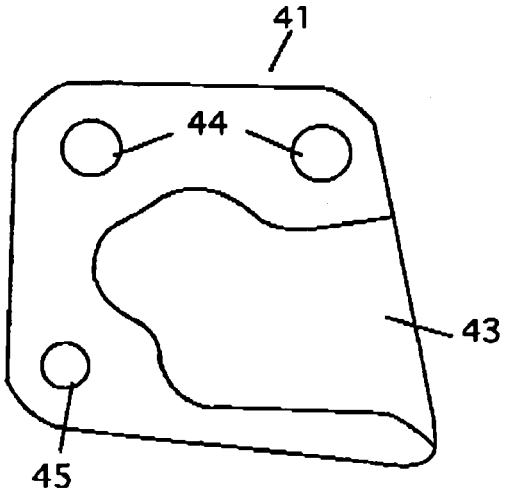
FIG. 9 is an inside view of the right side housing of the third embodiment.
Figure 11:
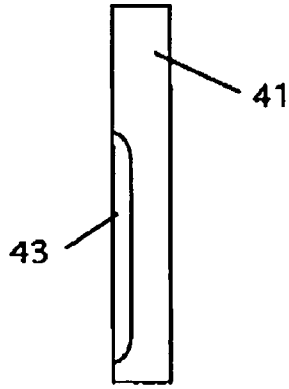
FIG. 11 is a front view of the right side housing of the third embodiment.

FIG. 8 is an inside view of the left side housing of the third embodiment. FIG. 9 is an inside view of the right side housing of the third embodiment. Here, the two housing members 40 and 41 are shown. These housings have recesses 42 and 43 formed in them to allow for debris to be cleared from the housing. They also have a set of mounting holes 44 and 45 formed in them. The mounting holes 44 are used to secure the second, or fixed jaw 30. The mounting holes 45 are used to mount the first jaw 20 through the pivot hole 24. In this way, the first jaw 20 is free to move about the pivot, as in the earlier embodiments. FIG. 10 is a front view of the left side housing 40 of the third embodiment. FIG. 11 is a front view of the right side housing 41 of the third embodiment.

Figure 12:
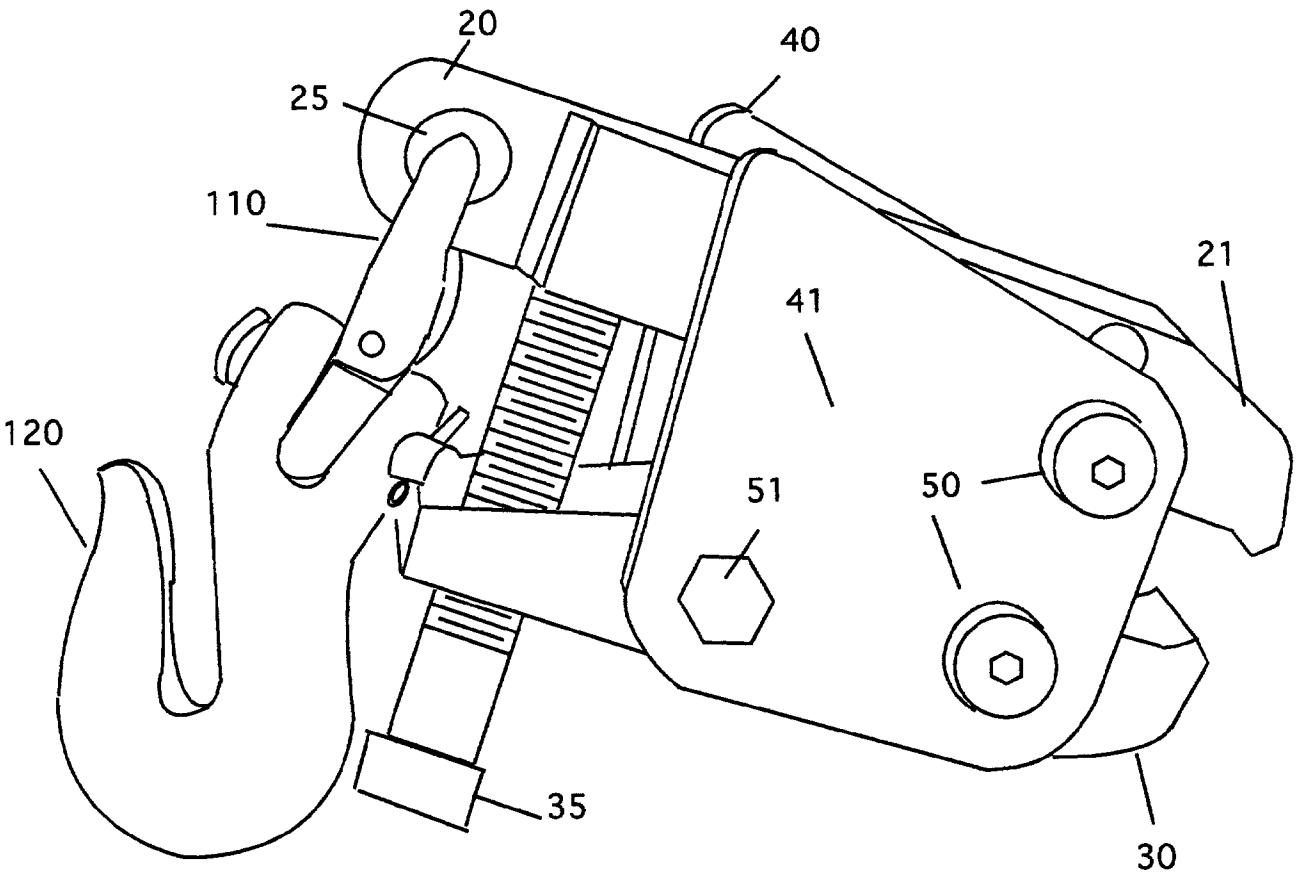
FIG. 12 is a perspective view of the third embodiment showing a shackle and hook attached to the first jaw.

FIG. 12 is a perspective view of the third embodiment showing a shackle 110 and hook 120 attached to the first jaw at hole 25. Here, the housing members 40 and 41 are shown secured to the jaws by bolts 50 and 51 and by nuts 52. The torque screw 35 is shown in place. As discussed above, this screw 35 is turned to close or open the jaws. With the hook 120 and shackle 110 attached, the device can be used with a chain, a come-along, or lift, to pull and manipulate the rim flanges, as discussed above. Note that the hole 25 in the first jaw is not limited to receiving a shackle. Any other connecting fastener, such as a clip, a pin, or a ring may be used as well.

Figure 13:
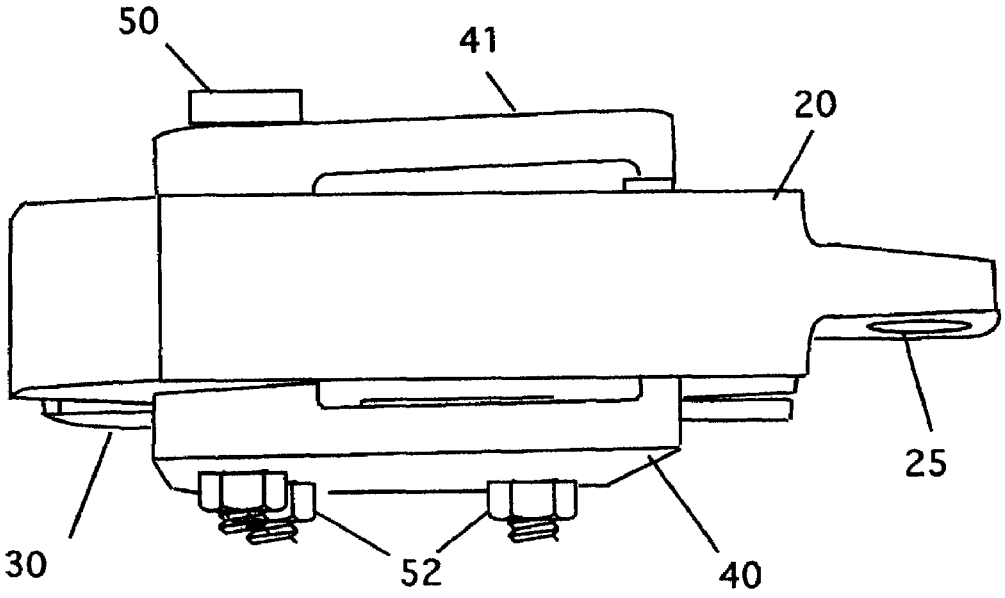
FIG. 13 is a top view of the third embodiment.

FIG. 13 is a top view of the third embodiment showing the placement of the jaws in the housings as well as the bolts.

Figure 14:
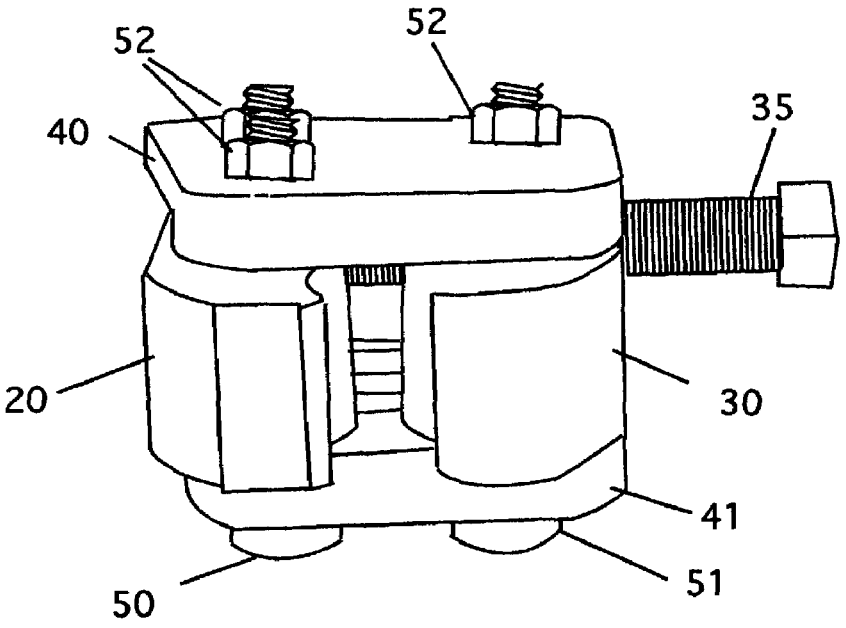
FIG. 14 is a front perspective view of the third embodiment.

FIG. 14 is a front perspective view of the third embodiment, showing the placement of the jaws in the housings as well as the bolts.

Figure 15:
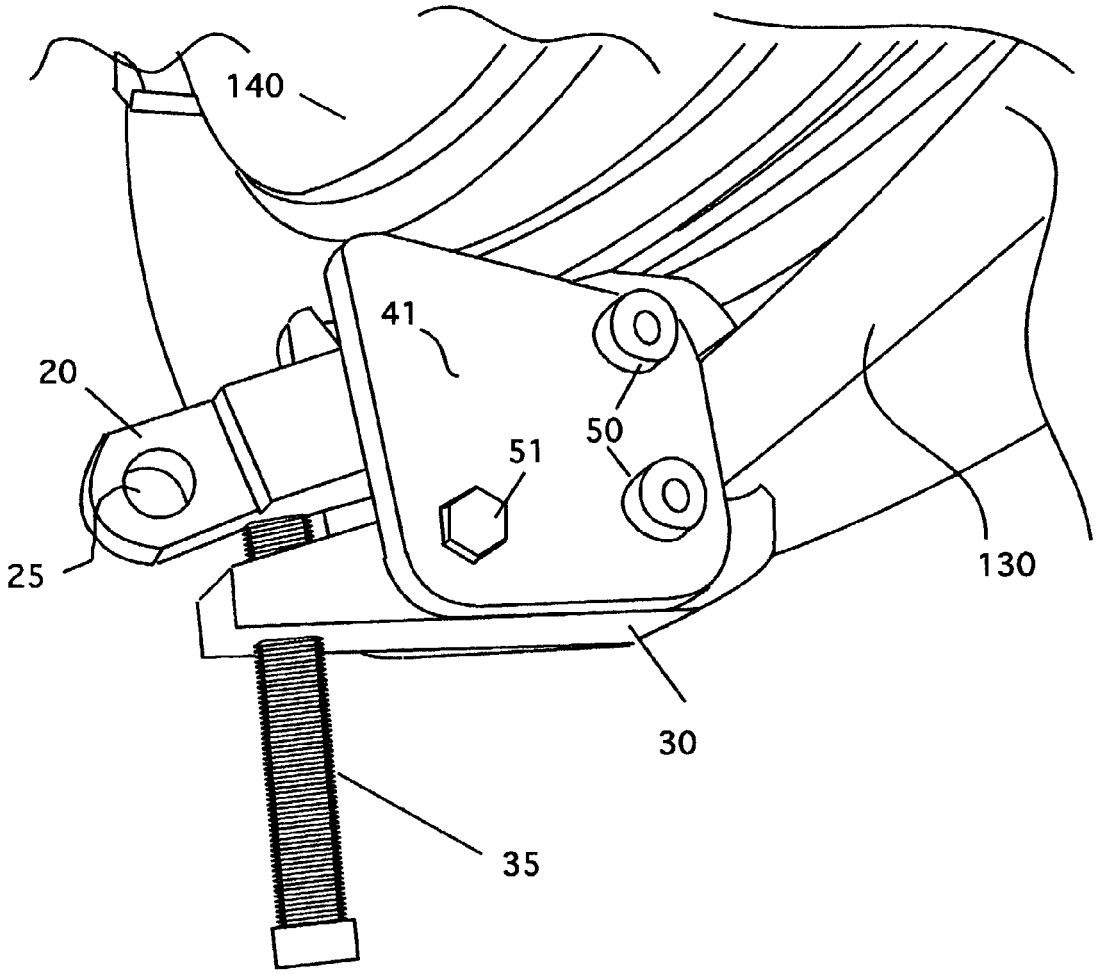
FIG. 15 is a detail view of the third embodiment on place on a rim flange.

FIG. 15 is a detail view of the third embodiment on place on a rim flange. Here, a rim flange 130 is shown as part of a wheel assembly 140. The clamp is secured to the rim flange 130 by opening the jaws and placing them over the flange. The torque screw 135 is then tightened down as before to close the jaws down on the rim flange so that it can be used to work the flange as desired.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A flange clamp comprising:

a) a first jaw;

b) a second jaw;

c) a housing;

d) a means for pivotably securing said first jaw in said housing;

e) a means for fixedly securing said second jaw in said housing;

f) a means for tightening said clamp, including a screw, having an end, said screw being threadably engaged in said second jaw, and passing completely therethrough; and further wherein the end of said screw contacts said first jaw, such that as said screw is turned said first jaw is pivoted in said housing;

g) a means for securing a pulling implement to said first jaw.

2. The flange clamp of claim 1 wherein the means for pivotably securing said first jaw in said housing include a bolt and nut.

3. The flange clamp of claim 1 wherein the means for fixedly securing said second jaw in said housing include a pair of bolts and nuts.

4. The flange clamp of claim 1 wherein the means for securing a pulling implement to said first jaw is an eye formed in said first jaw.

5. The flange clamp of claim 4 further comprising a shackle, removably attached to said eye in said first jaw.

6. The flange clamp of claim 1 wherein the means for securing a pulling implement to said first jaw is a hook, formed on said first jaw.

7. The flange clamp of claim 1 wherein the first jaw has a mounting hole formed therein for securing a connecting fastener therethrough.

8. The flange clamp of claim 1 wherein the pulling implement is selected from the group of: chain, rope, wire rope, and a come-along winch.

* * * * *